United States Patent [19]

Carter et al.

[11] 4,380,194

[45] Apr. 19, 1983

[54] APPARATUS FOR PRINTING INDICIA ON OBJECTS

[75] Inventors: Ned C. Carter, Chino; Jerry W. Cramer, Upland, both of Calif.

[73] Assignee: Sunkist Growers, Inc., Sherman Oaks, Calif.

[21] Appl. No.: 950,784

[22] Filed: Oct. 12, 1978

[51] Int. Cl.³ ..... B41F 17/34

[52] U.S. Cl. ..... 101/35; 101/329; 101/348

[58] Field of Search ..... 101/35, 36, 37, 40, 101/350, 329, 348

[56] References Cited

U.S. PATENT DOCUMENTS

| | | | |
|---|---|---|---|
| 587,253 | 7/1897 | Adler | 101/171 |
| 2,982,203 | 5/1961 | Ahlburg | 101/37 |
| 2,987,991 | 6/1961 | Johnson, Jr. et al. | 101/37 |
| 3,068,785 | 12/1962 | Ahlburg | 101/37 |
| 3,228,324 | 1/1966 | Russell | 101/40 |
| 3,712,215 | 1/1973 | Cunningham | 101/208 X |

FOREIGN PATENT DOCUMENTS

| | | | |
|---|---|---|---|
| 1140205 | 11/1962 | Fed. Rep. of Germany | 101/352 |

*Primary Examiner*—Clifford D. Crowder
*Attorney, Agent, or Firm*—Paul A. Weilein

[57] ABSTRACT

Apparatus for printing ink indicia on objects such as fruit and the like, which includes a conveyor to successively deliver the objects to a printing station where the indicia are applied to the respective objects by inked printing dies carried by a printing roller, the objects then being preferably discharged by the conveyor onto an appropriate receiver for collection or for moving them to a further processing station. In order to permit a rapid selection and interchange of inks having different characteristics, a plurality of inking rolls respectively charged with the different inks are carried by a turret assembly which is rotatable to engage a selected inking roll with the printing roller. The inking rolls are arranged to be axially reciprocated relative to the die roll, and are also adjustable to vary the engagement pressure between each of the inking rolls and the die roll.

6 Claims, 6 Drawing Figures

APPARATUS FOR PRINTING INDICIA ON OBJECTS

BACKGROUND OF THE INVENTION

The present invention relates generally to the field of printing and is more particularly concerned with apparatus for printing indicia on objects including food products, fruits and the like, and wherein the indicia may be selectively and interchangeably applied by inks having different characteristics.

A number of printing machines have been developed for applying ink indicia such as trademarks, trade names, designs and the like upon large numbers of objects such as those set forth above in a continuous, high speed operation. A typical printing machine of this type is disclosed by U.S. Pat. No. 2,987,991 issued June 13, 1961 to M. V. Johnson, Jr., et al and assigned to the assignee of the present invention, and is incorporated by reference into the present application.

Printing machines such as disclosed in the above patent include a continuous conveyor carrying a plurality of specially shaped and spaced apart rotatable rollers capable of orienting and aligning objects such as fruits and vegetables. In particular, the conveyor is adapted to orient ellipsoidally shaped articles or objects so that the long or major axes of the objects are parallel to the axes of the rollers. The conveyor then carries the fruits or objects successively to a printing station where inked printing dies apply an ink indicia upon the fruit or objects which are then transferred to a suitable receiver or for further processing.

Machines of this type have been highly developed in order to assure continued high speed operation over extended periods of time. For example, the machines are equipped with special ink rolls providing a sufficient ink supply for long periods of operation. To prevent damage to the fruits or other objects, the printing machines are equipped with die rolls including flexible mounting means for supporting the printing dies which transfer ink from the ink roll to the fruit or other objects as they are moved past the printing roll.

Machines of this type have been found generally to be satisfactory for the printing of indicia upon such objects. However, it has been discovered that it is often necessary and desirable to use inks or marking materials which vary widely as to the characteristics. For example, different citrus fruits such as lemons and oranges are typically stamped with indicia in different colors of ink to increase visibility of the mark. It may even be necessary or desirable at times to employ different inks upon the same type of fruit.

In the past, this has necessitated disassembly of the printing machine in order to replace the ink roll with another ink roll carrying the particular ink that is to be used. Such procedures result in undesirable delays and interfere with high speed processing of the fruits or other objects and thus cause inefficiency in the processing operations. Accordingly, a great need arises for a printing apparatus in which inks or marking materials of differing characteristics may be rapidly selected and interchanged without substantially interrupting or interfering with operation of the printing machine.

SUMMARY OF THE INVENTION

It is therefore an object of the invention to provide printing apparatus in which inks and marking materials of different characteristics may be selectively and interchangeably used in the application of the indicia. For such purpose, a plurality of inking rolls, respectively charged with the different printing media, are carried by a turret assembly which may be rotated to selectively place the selected inking roll in an operative position of engagement with a die roll carrying printing dies for transferring the ink or other marking material onto the fruits or other objects.

A further object of the invention is to provide printing apparatus according to the previous object in which a drive gear for each of the inking rolls may be selectively moved into operative engagement with a common driving gear as the selected inking roll is moved into operative engagement with the die roll.

Another object of the invention is to provide printing apparatus having operatively interchangeable inking rolls, and means for axially reciprocating the inking roll in order to assure contact of all portions of the inking roll surface with the printing means, and to better exhaust the available ink or marking material from each inking roll.

Yet another object of the invention is to provide in printing apparatus having interchangeable inking rolls, unique means for adjusting the operative contact pressure between the respective inking rolls and the dies of the die roll.

Further objects and advantages of the invention will be brought out in the following part of the specification, wherein detailed description is for the purpose of fully disclosing a preferred embodiment of the invention without placing limitations thereon.

BRIEF DESCRIPTION OF THE DRAWINGS

Referring to the drawings, which are for illustrative purposes only.

DESCRIPTION OF A PREFERRED EMBODIMENT

Figure 1:
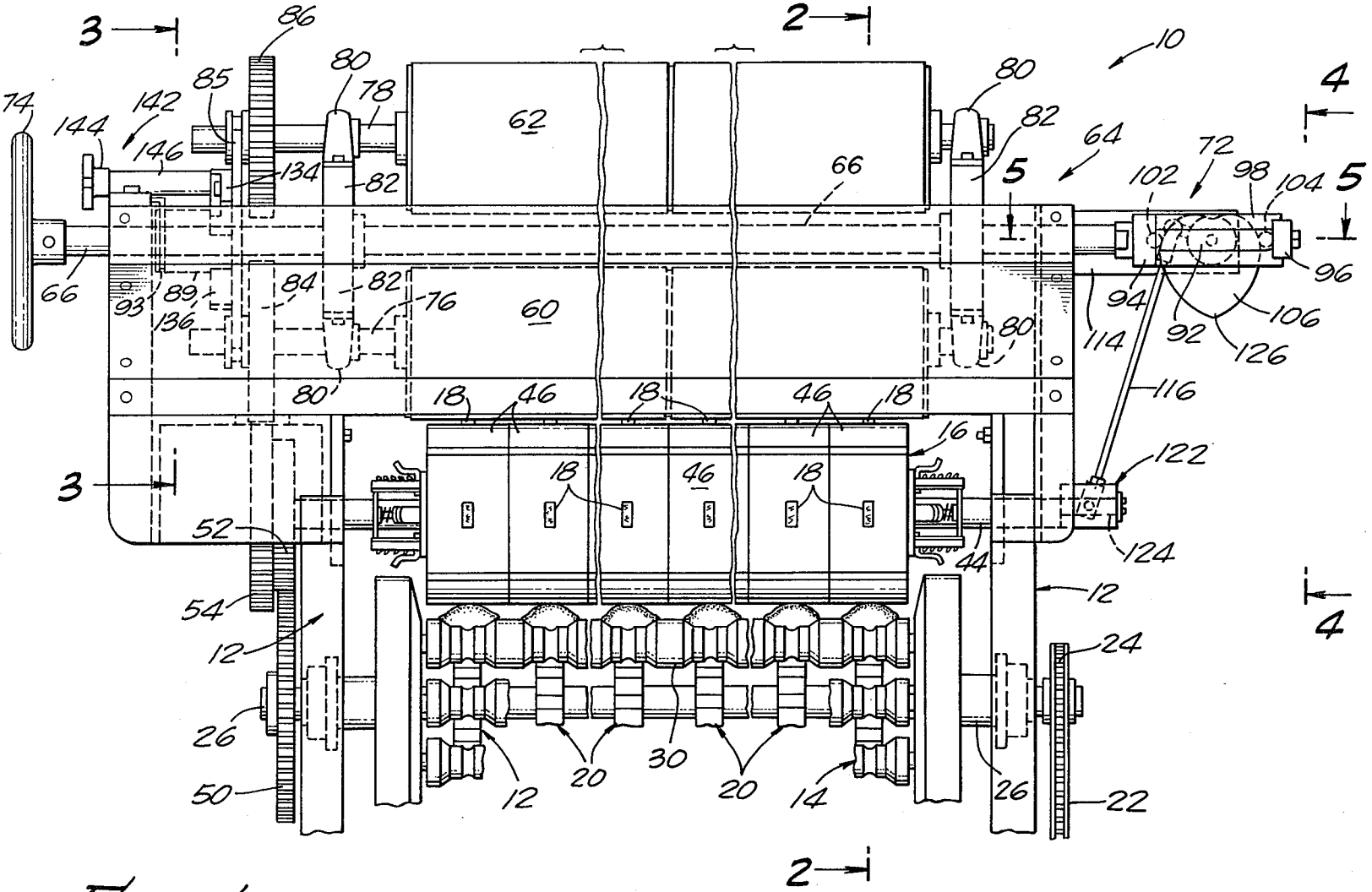
FIG. 1 is a fragmentary end elevational view of printing apparatus embodying the present invention.
Figure 2:
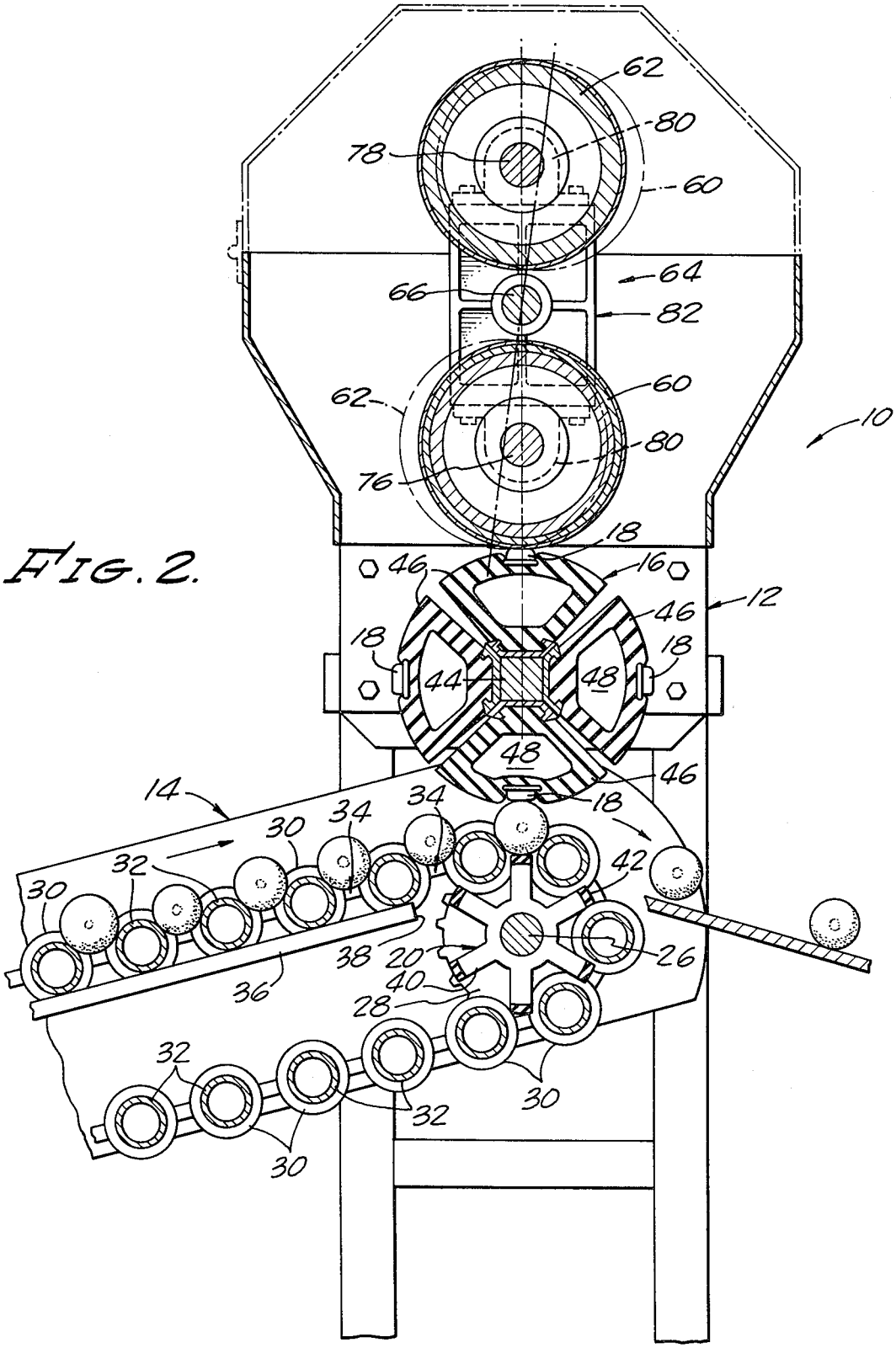
FIG. 2 is a fragmentary vertical sectional view taken substantially on line 2—2 of FIG. 1, and illustrating a printing station and the operative relationship of the interchangeable ink rolls and the die roll.

Referring now to the drawings and particularly to FIGS. 1 and 2, the printing apparatus of the present invention, as generally indicated by the numeral 10, is shown as comprising a suitable frame structure 12 for supporting a conventional orienting conveyor 14 constructed to carry fruits or other objects past a printing station defined by the operative area of association of the conveyor and a printing drum or die roll 16. The circumferential rows of axially spaced apart printing dies 18 are resiliently mounted upon the die roll. The spacing of the dies upon the roll 16 and the synchronized speed of the die roll 16 and conveyor 14 are selected so that each of the printing dies 18 respectively engage each of the fruits or other objects carried by the conveyor. Rotatably mounted platens 20 are arranged to extend through openings in the conveyor and operate to support the fruit or objects as they pass through the printing station. The conveyor, rotary platens and printing drum are synchronously driven from a common power source (not shown) by means of a drive chain 22 trained over a main drive sprocket 24 which is mounted in driving relation upon a main drive shaft 26.

Before proceeding further with the description, it may be noted that the construction of the conveyor 14, the rotary platens 20 and the printing drum 16 is substantially similar to that disclosed in the above mentioned patent. Accordingly, reference may be had to that patent for more specific details of the construction of those components.

To provide a basic understanding of the operation of the conveyor 20, it is of the chain type in which side chains are longitudinally looped to form upper and lower runs, the side chains being trained at opposite ends of the conveyor over similar supporting sprockets such as indicated at 28 at the delivery end of the conveyor adjacent the die roll 16, the sprockets 28 being mounted in rotatably driven relation upon the main drive shaft 26.

Rollers 30 are suitably supported for rotation between the conveyor drive chains in laterally spaced apart relation along the length of the conveyor. Each roller 30 includes an elongated cylinder or shaft 32 upon which are mounted in longitudinally spaced apart relation a plurality of annular sleeves, which preferably have a trapezoidal shape in axial half-section and are preferably formed from resilient material such as rubber. The sleeves supported upon adjacent rollers cooperate to form longitudinally aligned pockets 34 in which the individual fruits or objects are supported and oriented by rotation of the rollers 30 as they are moved along the conveyor toward the printing station.

As may be best seen in FIG. 2, an elongated roller actuating member 36 extends longitudinally beneath and in contact with the shaft portions 32 of the rollers 30 in order to rotate the rollers and orient the fruit as it is carried towards the printing station. One end 38 of the actuating member 36 is spaced from the platens so that rotational drive for the rollers is terminated before they enter the printing station beneath the die roll 16.

The rotating platens 20, as shown in FIGS. 1 and 2, are mounted in axially spaced apart relation upon the conveyor drive shaft 26, and each includes spokes 40 which extend between adjacent pairs of the rollers 30 as they pass beneath the die roll 16 in order to assist in supporting the fruit during the printing or marking operation. Preferably, the spokes 40 extend into the pockets 34 between the rollers 30 and terminate along an arc of revolution defined by rotation of the axis of each of the rollers 30 about the shaft 26. Each of the spokes 40 is preferably tipped with rubber or other flexible, resilient material 42 in order to provide a yielding support surface tending to protect the fruit or other objects from damage during the printing or marking operation.

The printing drum 16 is mounted on a square shaft 44 which is appropriately journalled at its ends on the support structure 12. The printing dies 18 are respectively supported at the periphery of segmental die holders 46 forming quadrants about the periphery of the shaft 44. The die holders are constructed of rubber, sponge rubber or other flexible, resilient material and are each formed with an internal cavity 48 to provide the necessary flexibility and resilient support for the printing die 18 mounted thereupon.

The conveyor and printing drum 16 are driven in synchronized relation through a gear train arrangement in which a gear 50 secured to the main drive shaft 26 meshes with a gear 52 secured to the square shaft 44. Another gear 54 is also secured in axially offset relation to the gear 52 upon the square shaft 44 for driving a selected inking roll in a manner described in greater detail below.

As was previously indicated, the components described above are constructed in substantial accordance with the above noted patent. Adaptation of such printing apparatus to include multiple inking rolls, means for engaging a selected inking roll in ink transferring engagement with the die roll, means for axially reciprocating the inking rolls and means for adjusting engagement pressure between any selected inking roll and the die roll in accordance with the present invention are described in greater detail below.

Although each of these features is a novel portion of the present invention, it is further noted that the construction of each individual inking roll is also of generally conventional construction. For example, as will be made apparent in greater detail below, the construction of each individual inking roll may correspond substantially with that shown and described in U.S. Pat. No. 3,068,785, issued Dec. 18, 1962 to F. Ahlburg and assigned to the assignee of the present invention. It is again noted that, although the construction of each individual inking roll may be conventional, the use of a plurality of inking rolls in a single printing apparatus, the manner in which the inking rolls are mounted in the printing apparatus and additional features such as the means for axially reciprocating the inking rolls and the means for varying their engagement pressure with the die roll are novel features of the present invention.

According to the present invention, inking rolls such as those indicated respectively at 60 and 62 are carried by a rotatable turret assembly generally indicated at 64 and adapted to selectively move the inking rolls 60 and 62 into operative engagement with the printing dies 18 on the die roll 16. The turret assembly 64 includes a central shaft 66 appropriately journalled at 68 and 70 upon the supporting frame structure 12. One end of the shaft 66 extends beyond the frame structure 12 for interconnection with a reciprocating drive assembly 72 described in greater detail below and also illustrated in FIGS. 4 and 5. The other end of the shaft 66 also extends beyond the frame structure 12 and is connected with a hand wheel 74 for manually rotating the entire turret assembly to position one or the other of the inking rolls 60 and 62 in operative engagement with the die roll 16.

Figure 3:
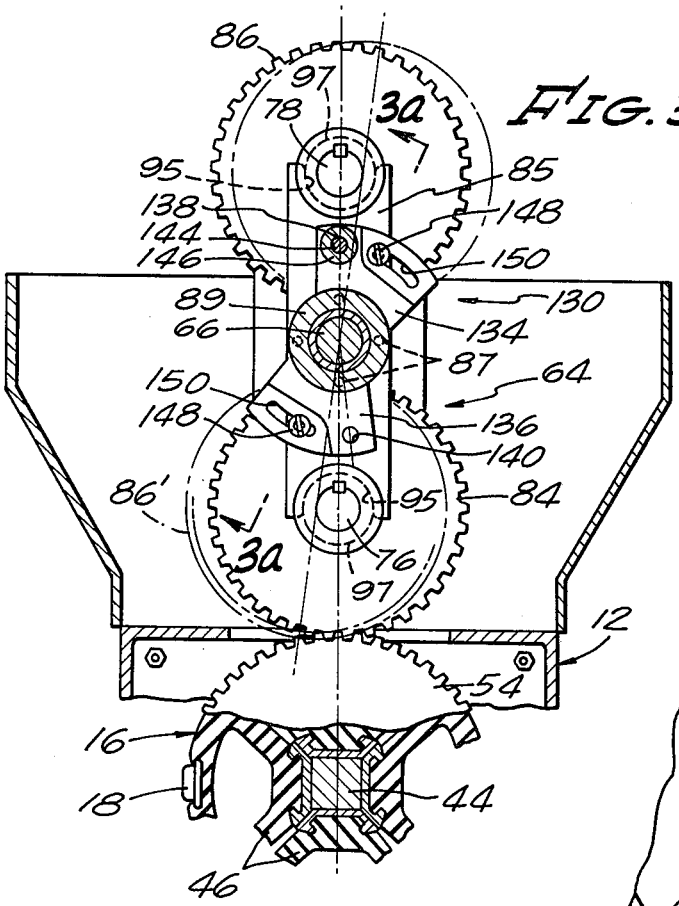
FIG. 3 is a fragmentary end view, with parts in section, taken substantially on line 3—3 of FIG. 1, and showing details of the means for adjusting the engagement pressure between the ink rolls and the die roll.

The inking rolls 60 and 62, as shown in FIGS. 1 and 2, include parallel central shafts 76 and 78, respectively, which are rotatably supported at their opposite ends in journal blocks 80 respectively mounted at the outer ends of a diametrically extending frame 82 that is centrally fixedly secured to the shaft 66. Referring particularly to FIGS. 1 and 3, it will be seen that each of the inking rolls 60 and 62 includes a separate drive gear, as indicated respectively at 84 and 86. The drive gears 84, 86 and the gear 54 are arranged with their planes of rotation in coincidental relation. In order to permit continued engagement of either of the gears 84, 86 with the gear 54 while also allowing for axial reciprocation of the inking rolls in response to the reciprocating drive assembly 72, the gears 84 and 86 are respectively mounted upon the shafts 76 and 78 by elongated splines as indicated at 88 and 90 in FIG. 6.

Figure 3A:
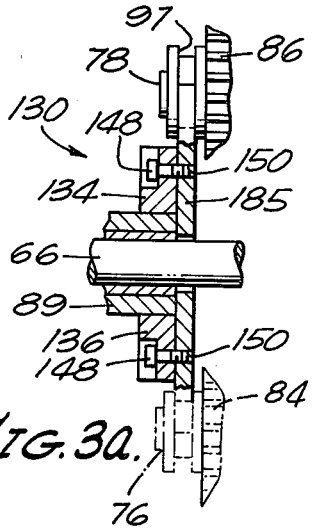
FIG. 3*a* is a fragmentary sectional view taken substantially on line 3*a*—3*a* of FIG. 3.
Figure 6:
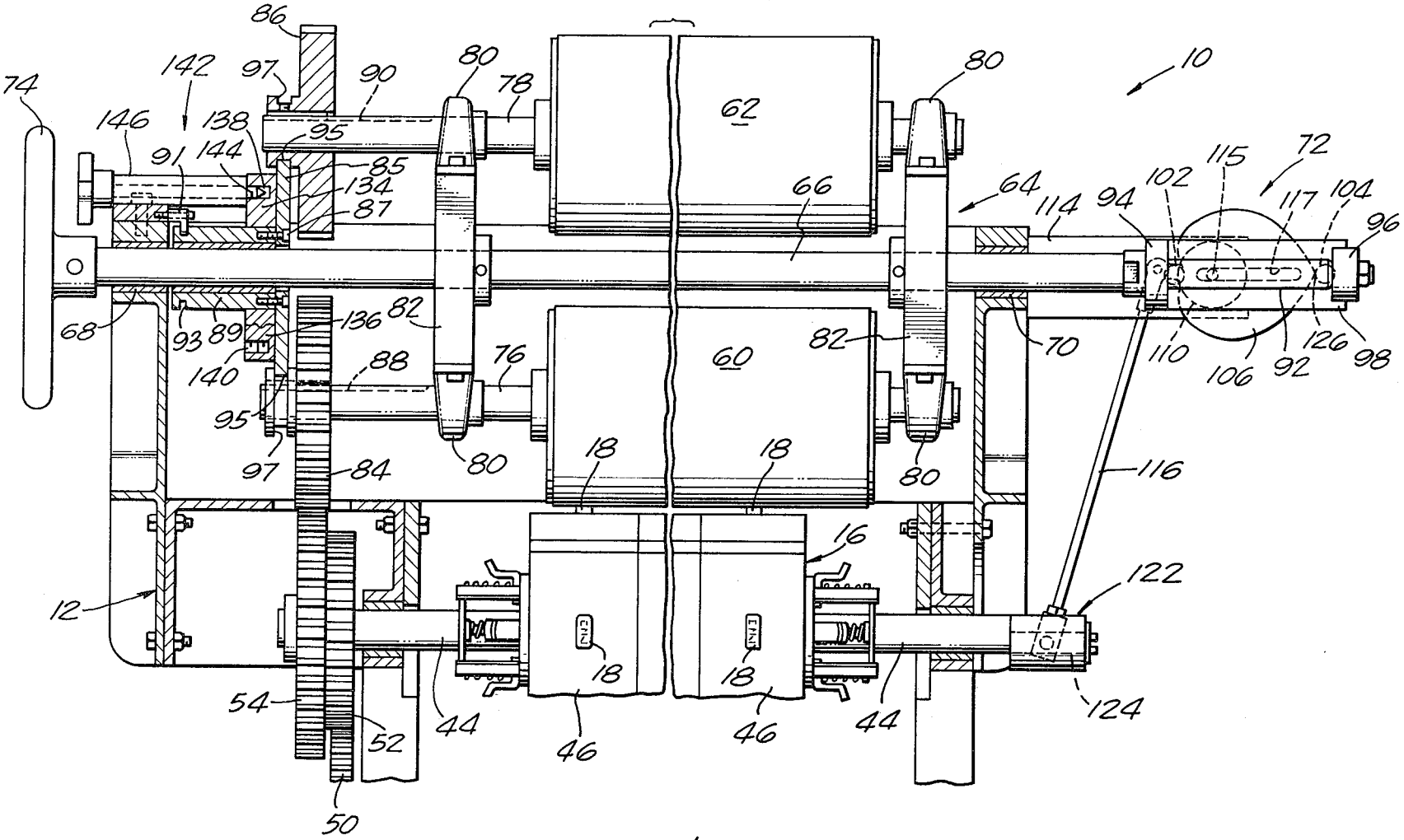
FIG. 6 is an enlarged fragmentary view generally similar to that of FIG. 1, and illustrating the inking rolls in a different axially reciprocated position from that shown in FIG. 1.

As best shown in FIGS. 3, 3*a* and 6, the gears 84, 86 are retained against axial displacement on their respective shafts 76 and 78 by means of a rotatable yoke structure which includes a diametrically extending plate member 85 that is centrally fixedly secured as by retaining bolts 87 to a central bushing 89 on the shaft 66. The bushing is retained against axial displacement on the shaft 66 by means of a keeper 91 secured to the adjacent frame structure 12 and having a projecting portion adapted to extend into a circumferentially extending groove 93 of the bushing. The outer ends of the plate member 85 are respectively formed with a semi-circular end notch 95 which permits the end to extend into a circumferentially extending hub groove 97 of the associated gear 84 or 86. As thus arranged, the gears are freely rotatable, but are axially retained against displacement.

Figure 4:
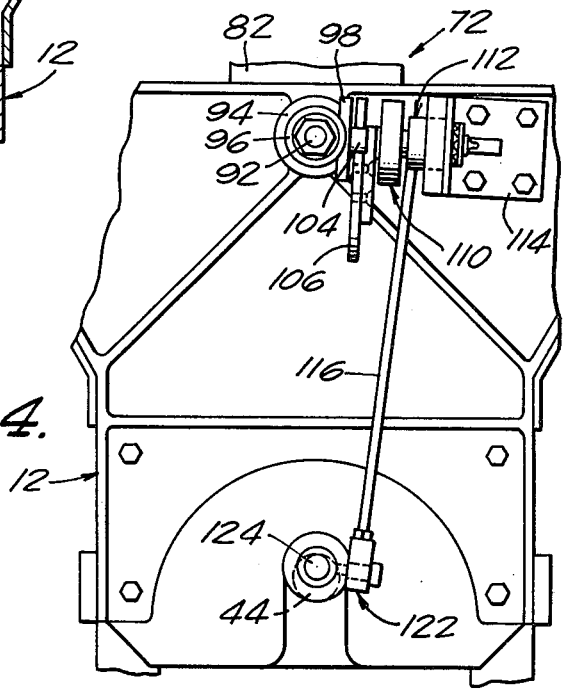
FIG. 4 is a fragmentary end view as seen from line 4—4 of FIG. 1 to illustrate structural details of the mechanism for producing reciprocating axial movements of the inking rolls.
Figure 5:
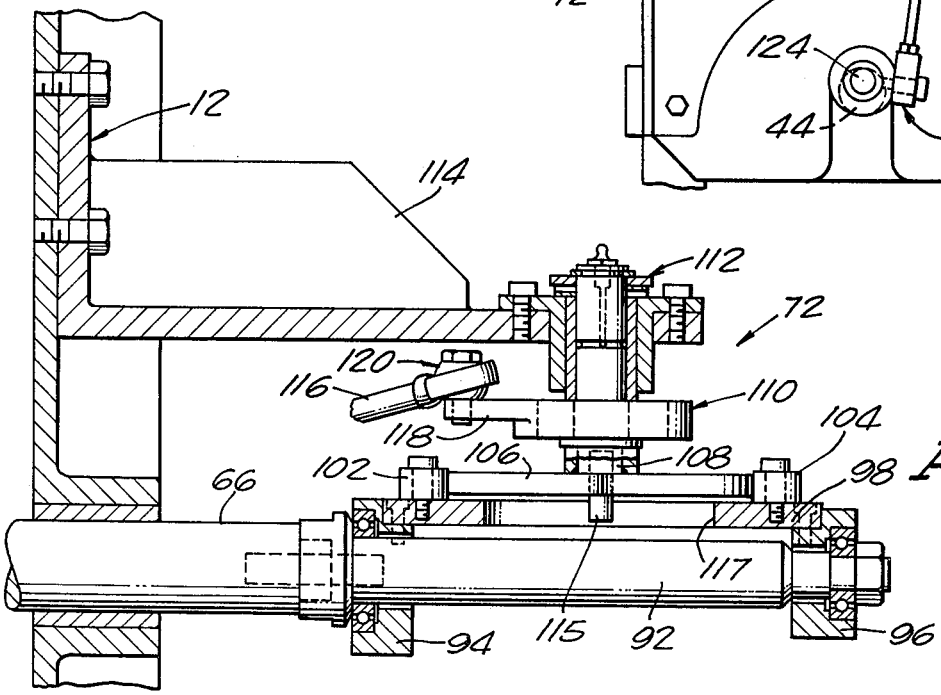
FIG. 5 is an enlarged fragmentary sectional view taken substantially on line 5—5 of FIG. 1 to illustrate additional details of the reciprocating mechanism.

The reciprocating drive assembly 72 is described below with reference to FIGS. 1 and 4–6. Referring particularly to FIGS. 4 and 5, the end of the shaft 66 adjacent the reciprocating drive assembly is secured to a shaft extension 92 carried by journal blocks 94 and 96 secured to a fixed plate 98. Cam followers 102 and 104 are secured to the plate 98 in spaced apart relation for engagement with opposite peripheral surface portions of a cam plate 106. The cam 106 is supported by a shaft 108 which is operatively connected with a clutch device 110 mounted by a suitable journal assembly 112 upon an extending portion 114 of the frame structure 12. A pin 115, offset from the center of the cam 106 rides in an elongated slot 117 formed in the plate 98 (see FIG. 6).

Operation of the clutch device 110 to accomplish rotation of the cam 106 is accomplished by means of a pitman 116 interconnected with an actuating element 118 of the clutch device 110 by means of a bearing assembly 120. As best seen in FIG. 4, the other end of the pitman 116 is connected with a bearing assembly 122 forming a connection with a driving eccentric 124 on the end of the printing drum drive shaft 44.

During each rotation of the printing drum drive shaft 44, the pitman 116 makes one complete reciprocating cycle which causes the clutch device 110 to rotate the cam 106 through an incremental portion of its rotational movement. The cam 106 preferably has a heart-shaped peripheral surface engaging the cam followers 102 and 104 in order to prevent hangup or dwell of the inking rolls at their axial limits of travel. In this connection, referring particularly to FIGS. 1 and 6, it will be seen that the longitudinal position of turret assembly shaft 66 will be determined by the engagement of the cam followers 102 and 104 with the cam 106 during its rotation. Opposite axial limits of travel for the inking rolls 60 and 62 are reached when either of the cam followers 102 and 104 is in engagement with the apex 126 of the cam 106. Such a position is illustrated in FIG. 6. As the cam 106 rotates 180 degrees, its apex 126 then engages the other cam follower, which corresponds to the opposite limit of axial travel for both of the inking rolls 60 and 62. At the same time that one of the cam followers engages the apex 126, the other cam follower engages the indented portion of the cam surface.

The advantage of using a heart-shaped cam surface may be best understood if it is momentarily assumed that a circular cam were to be employed. In that event, as the turret assembly reaches either axial limit of travel, it will experience a reduced rate of travel causing excessive delay at the axial limits of travel until after substantial angular movement of the circular cam. The heart-shaped cam configuration avoids this problem since, as the turret assembly reaches either axial limit of travel, one of the cam followers is in engagement with the apex 126 and only limited additional movement of the cam 106 is necessary to initiate the turret assembly movement in the opposite direction at a generally uniform rate of axial travel.

An adjustable locking assembly, generally indicated at 130, is arranged at the opposite end of the central turret assembly shaft 66 for selectively maintaining one of the inking rolls 60 and 62 in operative engagement with the die roll 16 and also for selectively varying the engagement pressure between those rolls. Referring particularly to FIGS. 3 and 3*a*, it will be seen that the shafts 76 and 78 for the inking rolls 60 and 62 are slidably positioned in the gears 84 and 86 at the opposite ends of the plate 85, as previously described.

Rotatable indexing plates 134 and 136 are mounted in separately rotatable relation upon the shaft 66 and are provided with holes 138 and 140 respectively for coaction with a locking mechanism 142 to releasably lock the turret assembly in a selected position in which one or the other of the inking rolls 60 and 62 is operatively engaged with the die roll. More specifically, the locking mechanism, as best seen in FIGS. 1 and 6, includes a spring-loaded plunger 144 arranged in a housing 146 secured to the frame structure 12. The spring-loaded plunger 144 is adapted to be selectively aligned with the holes 138 and 140 and upon entering either of these holes locks the entire turret assembly in its selected angular position. The rotatable indexing plates 134 and 136 are adjustably connected with the plate member 85 by set screws 148 passing through arcuate slots 150 in the indexing plate and threadedly engaged with the plate member 85.

The plunger 144 is partially indicated in the hole 138 for the indexing plate 134 and, as may be seen in FIG. 3, it is arranged directly above the axial center of the turret assembly shaft 66, and also directly above the axis of the die roll 16. The hole 138 is aligned with the axes of the turret assembly shaft 66 and the inking roll shafts 76 and 78. Accordingly, with the plunger 144 engaged in hole 138, the lower ink roll 60, positioned directly behind the gear 84 in FIG. 3, will be positioned directly above the die roll 16 and maximum engagement pressure established between these rolls.

The rotatable indexing plates may be adjusted to vary the angular position of either inking roll, when they are locked in position by the plunger 144, in order to decrease engagement pressure between the respective inking roll and the die roll. For example, the other rotatable indexing plate 136 is shown as having been adjusted slightly so that its hole 140 is slightly out of alignment with the axial centers of the turret assembly shaft 66 and inking roll shafts 76 and 78. Accordingly, if the entire turret assembly were rotated approximately 180 degrees to engage the plunger 144 in the hole 140, the inking roll 62 associated with the gear 86 will then be slightly offset from a position directly above the die roll, as is represented by the phantom position indicated at 86' in FIG. 3. With the gear 86 and associated inking roll being offset in that manner, it will be spaced somewhat farther apart from the axial center of the die roll and thus decrease the engagement pressure between the inking roll 60 and the die roll 16. Here again, it will be noted that the two rotatable indexing plates 134 and 136 may be independently preset in order to produce different pressures of engagement for the two inking rolls 60 and 62.

Numerous variations and modifications are believed apparent from the preceding description. In particular, it may be seen that the invention is not limited to the use of only two inking rolls in combination with a single die roll. In some applications, it may be desirable to provide a greater number of inking rolls in order to further increase the versatility of the apparatus. The additional inking rolls could be mounted in circumferentially spaced apart relation upon the turret assembly, each including a separate drive gear for engagement with the gear 54. In that event, the reciprocating drive assembly 72 would continue to provide the reciprocating motion for each of the increased number of inking rolls. Also, an adjustable locking assembly generally corresponding to that illustrated at 130 could also be provided for the increased number of inking rolls.

From the foregoing description and drawings, it will be clearly evident that the delineated objects and features of the invention will be accomplished.

Various modifications may suggest themselves to those skilled in the art without departing from the spirit of the invention and, hence, it is not wished to be restricted to the specific forms shown or uses mentioned, except to the extent indicated in the appended claims.

We claim:

1. In apparatus for printing indicia on objects in which a conveyor successively transports the individual objects to a printing station and a die roll in the printing station is synchronously rotatable to successively move printing dies arranged upon its periphery from an inking roll into printing engagement with the objects as they are delivered to the printing station, the improvement comprising:

a plurality of inking rolls each supported upon a drive shaft and being adapted to be charged with inks having different characteristics, said drive shafts being journalled on a turret mounted on a manually rotatable supporting shaft and in fixed circumferentially and radially spaced relation;

means for releasably locking said turret in positions of rotation wherein a selected inking roll is in operative engagement with the die roll;

means for establishing a driving connection with the drive shaft of the selected inking roll in its operative position for driving it in synchronized relation to the die roll; and said locking means including adjustment means for circumferentially varying the radial angular locked position of the turret within predetermined limits in order to adjust the engagement pressure between the selected inking roll and the die roll.

2. In apparatus for printing indicia on objects in which a conveyor successively transports the individual objects to a printing station and a die roll in the printing station is synchronously rotatable to successively move printing dies arranged upon its periphery from an inking roll into printing engagement with the objects as they are delivered to the printing station, the improvement comprising:

a plurality of inking rolls adapted to be charged respectively with inks having different characteristics;

a rotatable turret for supporting the inking rolls in circumferentially spaced relation, said inking rolls being respectively independently supported on said turret by a rotatable shaft;

means for selectively moving one of said inking rolls into operative engagement with the die roll comprising a manually rotatable supporting shaft for said turret;

means for driving the selected inking roll in synchronized relation to the die roll comprising drive gears respectively carried by each of said inking roll shafts, said gears having splined connection with their associated shafts enabling relative sliding axial movements between the gears and shafts; and means including a rotatable yoke having connections respectively with said drive gears, and being operative to retain said gears with their planes of rotation in coincidental relation.

3. Printing apparatus according to claim 2, in which:

said yoke is rotatably mounted on said turret supporting shaft and comprises a plate member having outer ends slidingly seated in hub grooves of said inking roll drive gears.

4. Printing apparatus according to claim 3, in which:

the die roll is supported on a rotatably mounted shaft; and a driven gear secured to said die roll shaft is positioned with its plane of rotation in coincidence with the planes of rotation of said drive gears for the inking rolls, whereby upon movement of a selected inking roll into operative association with said die roll, the drive gear of the selected inking roll will operatively mesh with said driven gear for the die roll.

5. In apparatus for printing indicia on objects in which a conveyor successively transports the individual objects to a printing station and a die roll in the printing station is synchronously rotatable to successively move printing dies arranged upon its periphery from an inking roll into printing engagement with the objects as they are delivered to the printing station, the improvement comprising:

a plurality of inking rolls adapted to be charged respectively with inks having different characteristics;

a rotatable turret for supporting the inking rolls in circumferentially spaced relation;

means for selectively moving one of said inking rolls into operative engagement with the die roll comprising a manually rotatable supporting shaft for said turret;

means for releasably locking said turret in the respective operating positions of the selected inking roll including adjustment means for slightly varying the angularly locked position of the turret in order to adjust the engagement pressure between the selected inking roll and the die roll;

said locking means comprising at least one rotatable indexing plate formed with a hole for releasably receiving a locking plunger, said indexing plate being movable relative to the turret for adjusting its angularly locked position; and means for driving the selected inking roll in synchronized relation to the die roll.

6. Printing apparatus according to claim 5, in which:

a separate rotatably mounted indexing plate is operatively associated with each of said inking rolls.

* * * * *